US010794393B2

(12) United States Patent
Huang et al.

(10) Patent No.: US 10,794,393 B2
(45) Date of Patent: Oct. 6, 2020

(54) IMPELLER, FAN AND METHOD FOR MANUFACTURING FAN BLADE

(71) Applicant: PEGATRON CORPORATION, Taipei (TW)

(72) Inventors: Chao-Kai Huang, Taipei (TW); Tzu-Ming Yang, Taipei (TW); Yu- Hao Chiu, Taipei (TW); Ming-Yang Hsiao, Taipei (TW)

(73) Assignee: Pegatron Corporation, Taipei (TW)

( * ) Notice: Subject to any disclaimer, the term of this patent is extended or adjusted under 35 U.S.C. 154(b) by 119 days.

(21) Appl. No.: 16/135,526

(22) Filed: Sep. 19, 2018

(65) Prior Publication Data

US 2019/0162201 A1 May 30, 2019

(30) Foreign Application Priority Data

Nov. 24, 2017 (TW) ..... 106141070 A

(51) Int. Cl.

| | |
|---|---|
| ***F04D 29/34*** | (2006.01) |
| ***F04D 29/28*** | (2006.01) |
| ***F04D 29/30*** | (2006.01) |
| ***F04D 29/32*** | (2006.01) |
| ***F04D 29/38*** | (2006.01) |
| ***F04D 25/06*** | (2006.01) |

(52) U.S. Cl.

CPC ..... *F04D 29/34* (2013.01); *F04D 25/0613* (2013.01); *F04D 29/281* (2013.01); *F04D 29/305* (2013.01); *F04D 29/329* (2013.01); *F04D 29/382* (2013.01); *F04D 29/388* (2013.01); *F05D 2230/10* (2013.01); *F05D 2230/232* (2013.01); *F05D 2230/51* (2013.01); *F05D 2230/54* (2013.01); *F05D 2240/30* (2013.01)

(58) Field of Classification Search

CPC .. F04D 25/0613; F04D 29/388; F04D 29/305; F04D 29/382; F04D 29/281; F04D 29/329; F04D 29/34; F05D 2230/10; F05D 2230/51; F05D 2230/54; F05D 2230/232; F05D 2240/30

See application file for complete search history.

(56) References Cited

U.S. PATENT DOCUMENTS 1,035,364 A * 8/1912 LeBlanc ..... F01D 5/282 416/230
1,053,321 A * 2/1913 Scrock ..... F04C 5/00 418/156
2,947,066 A 8/1960 Tumavicus
3,202,343 A * 8/1965 Emmermann ..... F04D 29/305 415/198.1

(Continued)

FOREIGN PATENT DOCUMENTS

EP 2706241 A2 3/2014

*Primary Examiner* — Igor Kershteyn

(74) *Attorney, Agent, or Firm* — Muncy, Geissler, Olds & Lowe, P.C.

(57) ABSTRACT

An impeller includes a hub and a plurality of blade plates. The hub includes a hub body and a plurality of installation portions disposed on the hub body. Each blade plate includes a plurality of fan blades and a folding portion. The folding portion is connected to one end of each fan blade. The folding portions are respectively installed at the installation portions.

11 Claims, 7 Drawing Sheets

(56) References Cited

U.S. PATENT DOCUMENTS

| | | | | | |
|---|---|---|---|---|---|
| 3,990,808 | A * | 11/1976 | Isaacson | F04D 29/28 | 415/141 |
| 4,098,559 | A * | 7/1978 | Price | F01D 5/225 | 416/212 A |
| 4,547,126 | A * | 10/1985 | Jackson | F04D 29/382 | 416/132 A |
| 5,573,376 | A * | 11/1996 | Hayden | F04D 29/321 | 29/888.025 |
| 5,584,656 | A | 12/1996 | Rose | | |
| 5,993,158 | A * | 11/1999 | Young | A47J 43/1068 | 416/132 A |
| 7,121,805 | B2 * | 10/2006 | Chang | F04D 29/34 | 416/210 R |
| 2013/0101427 | A1 | 4/2013 | Chen et al. | | |
| 2014/0271207 | A1 * | 9/2014 | Drane | F04D 29/023 | 416/193 A |
| 2016/0001407 | A1 | 1/2016 | Hansen et al. | | |

* cited by examiner

IMPELLER, FAN AND METHOD FOR MANUFACTURING FAN BLADE

CROSS REFERENCE TO RELATED APPLICATIONS

This Non-provisional application claims priority under 35 U.S.C. § 119(a) on Patent Application No(s). 106141070 filed in Taiwan, Republic of China on Nov. 24, 2017, the entire contents of which are hereby incorporated by reference.

BACKGROUND

Technology Field

The present disclosure relates to an impeller, a fan and a method for manufacturing the fan blade. In particular, the present disclosure relates to a thin impeller, a fan and a method for manufacturing fan blades.

Related Art

The fans are generally applied to dissipate the heat of various electronic devices, such as the notebook computers, graphic cards, main boards, CPU, desktop computers, projectors, computers, and the likes. Since the electronic devices are developed to be lighter and compact, the fan is also designed smaller to be installed inside the housing of the electronic device.

In general, a fan includes an impeller and a motor. The motor can drive the impeller to rotate. The impeller includes a hub and a plurality of blades, and the blades are disposed around the hub. The impeller is usually manufactured by plastic ejection molding, and the hub and the blades are integrally formed as one piece. In this case, the material of the blades of the impeller is also limited to the plastic material, and the metal blades become unavailable. Moreover, the thickness of the blades cannot be further minimized due to the property of the plastic material. This is improper to manufacture the thinner impeller and the thinner fan, so that the entire volume of the electronic device installed with the fan and impeller cannot be smaller.

Therefore, it is an important subject to provide a thin impeller that can be easily manufactured, a fan containing the thin impeller, and a method for manufacturing fan blades of the thin impeller.

SUMMARY

In view of the foregoing, an objective of this disclosure is to provide a thin impeller that can be easily manufactured, a fan containing the thin impeller, and a method for manufacturing fan blades of the thin impeller.

To achieve the above objective, an impeller comprises a hub and a plurality of blade plates. The hub comprises a hub body and a plurality of installation portions disposed on the hub body. Each of the blade plates comprises a plurality of fan blades and a folding portion connected to one end of each of the fan blades. The folding portions are respectively installed at the installation portions.

In one embodiment, the blade plates are metal plates.

In one embodiment, each of the blade plates is folded along the folding portion so that an included angle is formed between the fan blades.

In one embodiment, each of the installation portions is a recess, and the folding portions are inserted into the installation portions, respectively.

In one embodiment, each of the recesses is gradually shrunk from an edge of the hub body toward a center of the hub body, two of the fan blades of the blade plate corresponding to the recess contact against two sides of the recess, and the folding portion contacts against a deepest side of the recess.

In one embodiment, the impeller further comprises a hub cover. The hub cover covers the installation portions and the folding portions, and connects to the hub body and the folding portions.

In one embodiment, the shapes and sizes of the fan blades of each of the blade plates are the same.

In one embodiment, the blade plate comprises an even number of the fan blades. For example, one blade plate may comprises two, four or six fan blades.

In one embodiment, the shapes and sizes of the fan blades of one blade plate are different.

To achieve the above, a fan comprises the above-mentioned impeller and a motor. The motor is assembled with the impeller.

To achieve the above, a method for manufacturing fan blades comprises: cutting a metal plate to obtain a blade plate, wherein the blade plate comprises a plurality of fan blades and a folding portion, and the folding portion is connected to one end of each of the fan blades; pressing the fan blades to form the curved fan blades; and folding the blade plate along the folding portion.

As mentioned above, in the impeller and fan of this disclosure, each blade plate comprises a plurality of fan blades. Accordingly, when installing one blade plate on the hub, two or more fan blades can be provided on the hub. Thus, the fan blades are not installed on the hub individually. This design can decrease the assembling time for installing the fan blades on the hub, thereby reducing the manufacturing time of the impeller and the fan.

Moreover, this disclosure can provide multiple fan blades on the hub by installing one blade plate, so the manufacturing procedure becomes simpler. The folding portion of the blade plate can be directly inserted into the hub. The installation procedure of this disclosure is much easier than installing a plurality of individual fan blades.

Furthermore, the blade plates can be made of metal plates, so that the metal blade plates can be manufactured thinner than the convention plastic fan blades. Thus, the generated air quantity becomes larger so as to increase the heat dissipation efficiency.

BRIEF DESCRIPTION OF THE DRAWINGS

The disclosure will become more fully understood from the detailed description and accompanying drawings, which are given for illustration only, and thus are not limitative of the present disclosure, and wherein.

DETAILED DESCRIPTION OF THE EMBODIMENTS

The present disclosure will be apparent from the following detailed description, which proceeds with reference to the accompanying drawings, wherein the same references relate to the same elements.

Figure 1A:
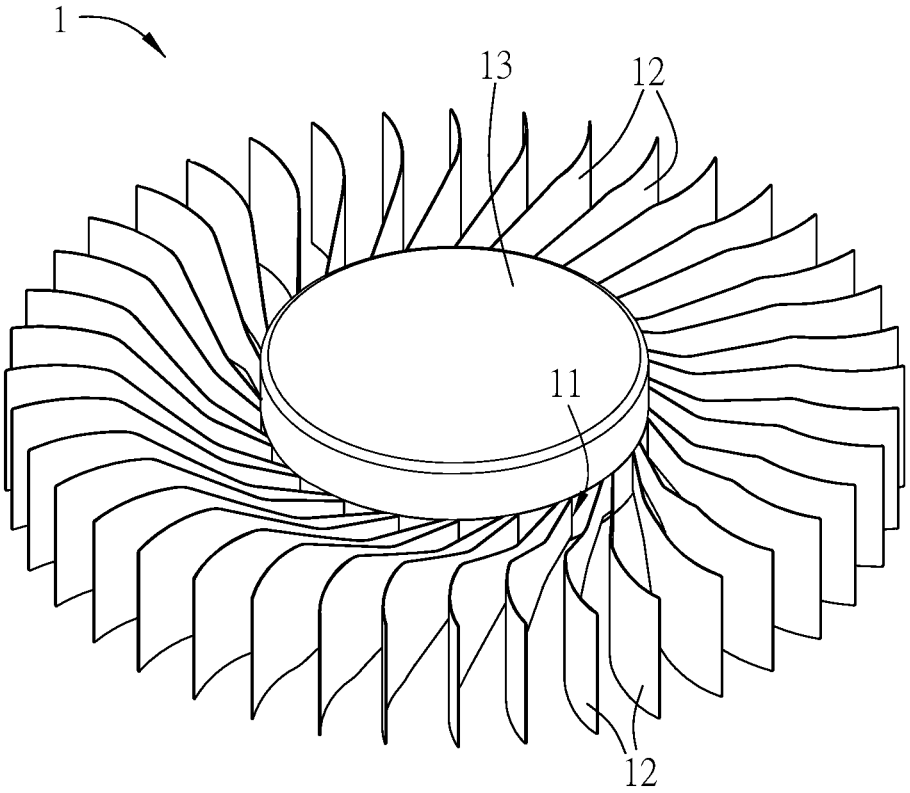
FIG. 1A is a schematic diagram showing an impeller according to an embodiment.
Figure 1B:
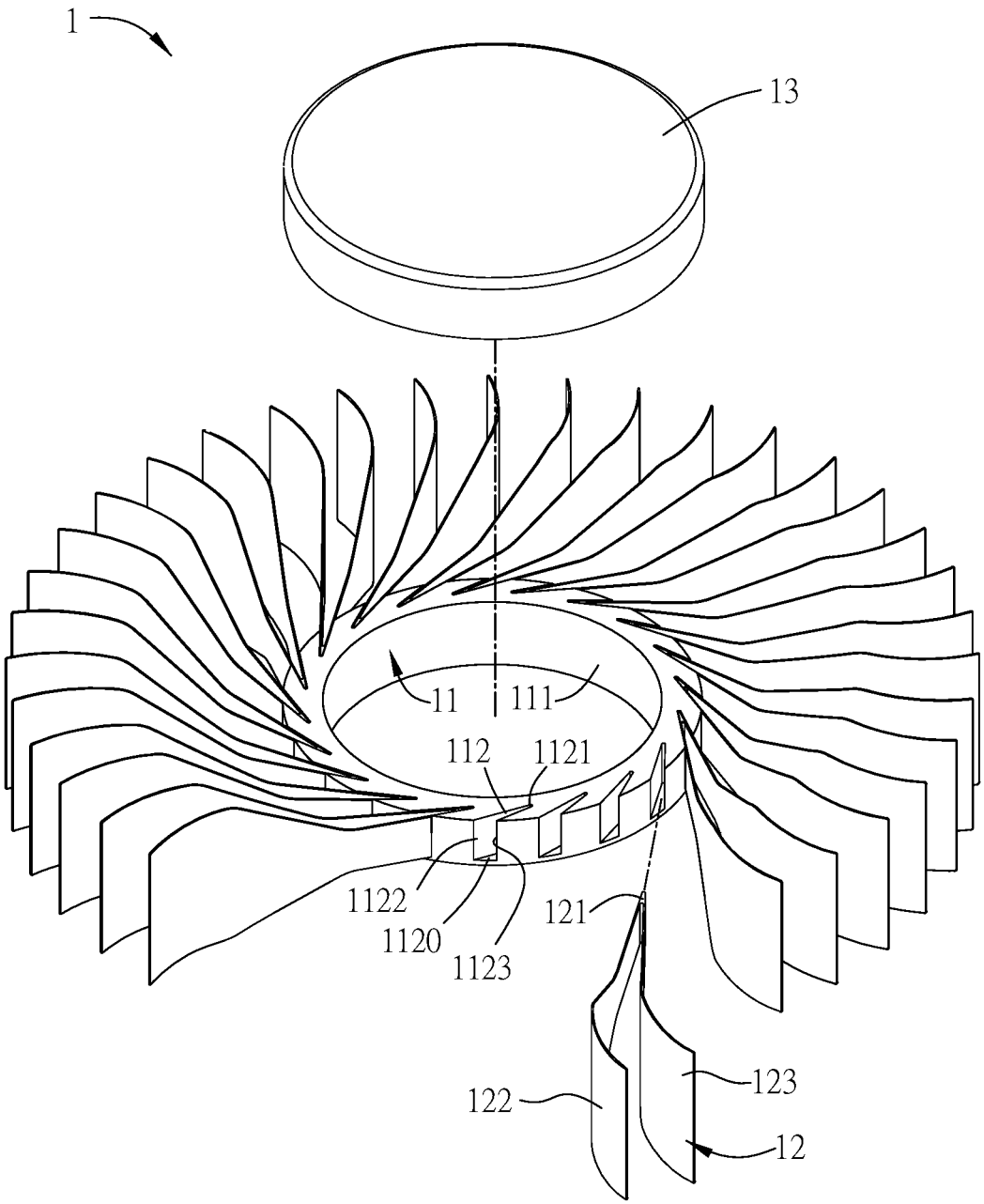
FIG. 1B is an exploded view of the impeller of FIG. 1A.

FIG. 1A is a schematic diagram showing an impeller according to an embodiment, and FIG. 1B is an exploded view of the impeller of FIG. 1A. As shown in FIGS. 1A and 1B, an impeller 1 comprises a hub 11 and a plurality of blade plates 12. The hub 11 comprises a hub body 111 and a plurality of installation portions 112 disposed on the hub body 111. Each of the blade plates 12 comprises a plurality of fan blades 122 and 123 and a folding portion 121 connected to one end of each of the fan blades 122 and 123. The folding portions 121 are respectively installed at the installation portions 112. The one ends of the fan blades 122 and 123 can be, for example but not limited to, the roots of the fan blades.

Referring to FIGS. 1A and 1B, the amount of the fan blades of one blade plate 12 is, for example but not limited to, two. In some examples, the amount of the fan blades of one blade plate 12 can be four or six.

Each of the fan blades 122 and 123 is folded along the folding portion 121 so that an included angle is formed between one end of the fan blades 122 and 123 around the folding portion 121. The fan blades 122 and 123 can, for example but not limited to, be equivalently folded. The included angle is a sharp angle, which is less than about 15 degrees and greater than 0 degree. When the included angle is smaller, the fan blades 122 and 123 can be arranged closer.

As shown in FIG. 1B, each of the installation portions 112 comprises a recess 1120, and the folding portions 121 are inserted into the installation portions 112, respectively. Each of the recesses 1120 is gradually shrunk from the edge of the hub body 111 toward the center of the hub body 111. Two of the fan blades 122 and 123 of the blade plate 12 corresponding to the recess 1120 contact against two sides 1122 and 1123 of the recess 1120, and the folding portion 121 contacts against a deepest side 1121 of the recess 1120.

In the folded blade plate 12, the total volume of the ends of the fan blade 122 and 123 and the folding portion 121 is slightly smaller than the size of the recess 1120, so that the folding portion 121 can be easily inserted into the recess 1120 of the installation portion 112 in the step for installing the blade plates 12 at the installation portions 112.

In addition, the total volume of the ends of the fan blade 122 and 123 and the folding portion 121 can be equal to the size of the recess 1120, so that the folding portion 121 can still be inserted into the recess 1120 of the installation portion 112 without much difficult in the step for installing the blade plates 12 at the installation portions 112.

In addition, the total volume of the ends of the fan blade 122 and 123 and the folding portion 121 can be slightly larger than the size of the recess 1120. Thus, the step for installing the blade plates 12 at the installation portions 112 comprises the following steps of: pressing the fan blades 122 and 123 to temporarily minimize the volume thereof (to be slightly smaller than or equal to the size of the recess 1120); and inserting the folding portion 121 into the recess 1120 of the installation portion 112. After installing the blade plate 12 into the installation portion 112, the fan blade 122 and 123 will recover and extend towards two sides of the recess 1120. Accordingly, the fan blades 122 and 123 can be tightly contacted against the two sides 1122 and 1123 of the recess 1120, thereby firmly fixing the fan blade 12 to the installation portion 112.

Based on the above installation method, installing one blade plate 12 can simultaneously provide multiple fan blades 122 and 123. This installation method is simpler. Moreover, the folding portion 121 of the blade plate 12 can be directly inserted into the hub 11. This inserting step is easier than the conventional art of installing each single fan blade on the hub.

Referring to FIG. 1B, the distance between two adjacent recesses 1120 of the installation portions 112, which are disposed along the edge of the hub 11, is roughly equal to the distance between two fan blades 122 and 123 of one blade plate 12. Accordingly to this configuration, the distance between two fan blade 122 and 123 of one blade plate 12 is equal to the distance between two fan blade 122 and 123 of the next blade plate 12.

In addition, in one blade plate 12, the shapes and sizes of the fan blades 122 and 123 are the same. Installing one blade plate 12 on the hub 11 can simultaneously provide multiple identical fan blades 122 and 123. Thus, the fan blades are not installed on the hub individually. This design can decrease the assembling time for installing the fan blades 122 and 123 on the hub 11, thereby reducing the manufacturing time of the impeller and the fan. The shapes and sizes of the fan blades 122 and 123 of each of the blade plates 12 are the same, so that installing multiple blade plate 12 on the hub 11 can simultaneously provide more identical fan blades 122 and 123.

The hub 11 can be made of plastic material, and the blade plate 12 can be made of a metal plate, such as, for example but not limited to, a stainless steel plate, an aluminum alloy plate, or the likes. The metal blade plates can be manufactured thinner than the convention plastic fan blades. Thus, the generated air quantity becomes larger so as to increase the heat dissipation efficiency.

The impeller 1 may further comprise a hub cover 13. The hub cover 13 covers the installation portions 112 and the folding portions 121 of the blade plates 12 for preventing the blade plates 12 from falling off the installation portions 112. The hub cover 13 connects to the hub body 111 and the folding portions 121 of the blade plates 12 for further firmly fixing the components and preventing the blade plates 12 from falling off the installation portions 112. The hub cover 13 can connect to the hub body 111 and the folding portions 121 of the blade plates 12 by adhering, fusing (e.g. thermal fusing), welding (e.g. ultrasonic welding), engaging, or the likes.

For example, the hub cover 13 is made of plastic material. The folding portions 121 of the blade plates 12 are installed in the installation portions 112 of the hub 11, and then the hub cover 13 is disposed on the hub body 111 for covering the installation portions 112 and the folding portions 121. Afterwards, the ultrasonic welding is applied for fixing the hub cover 13, the installation portions 112 and the folding portions 121 together.

Figure 2:
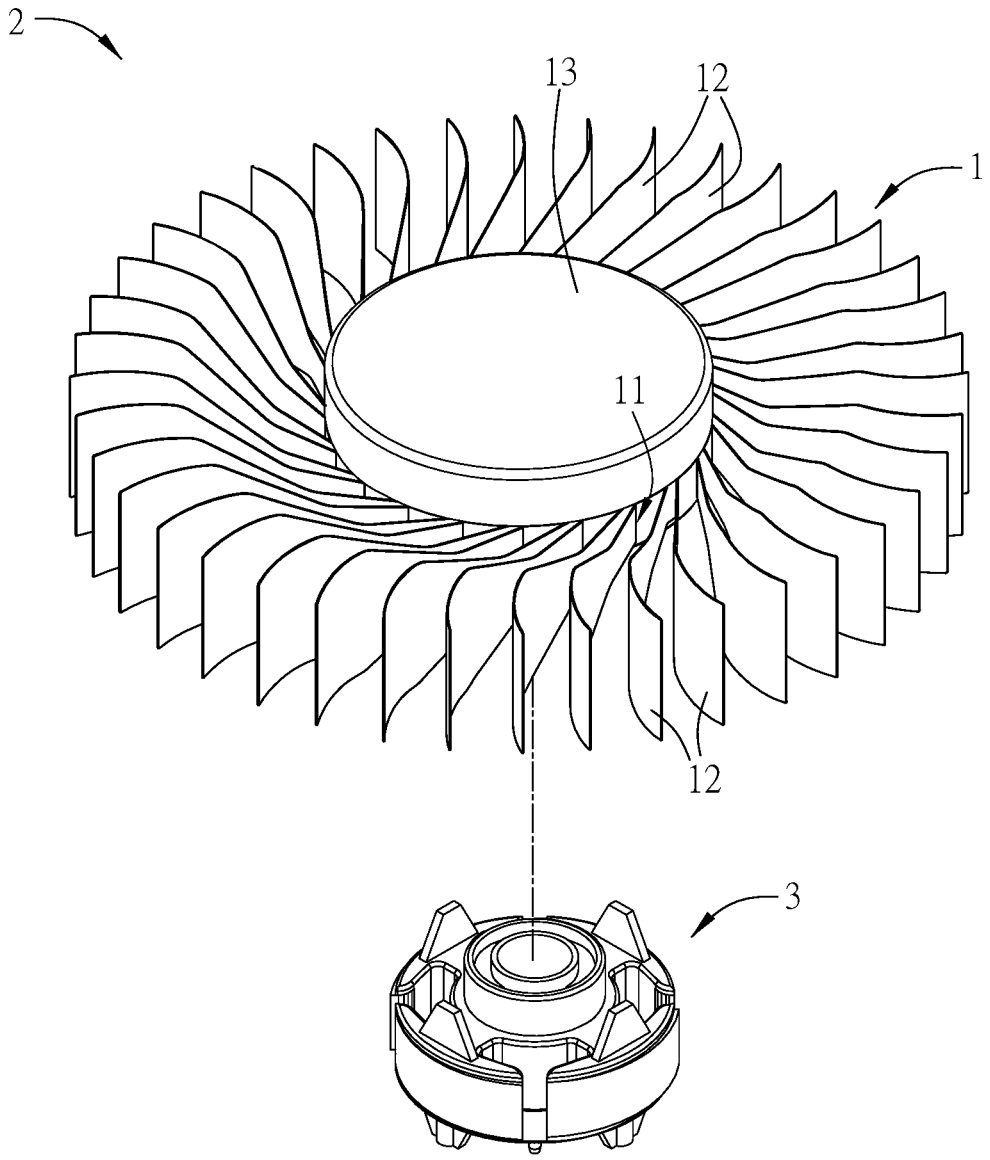
FIG. 2 is a schematic diagram showing a fan according to an embodiment.

FIG. 2 is a schematic diagram showing a fan according to an embodiment. As shown in FIG. 2, the fan 2 comprises an impeller 1 and a motor 3. The motor 3 is assembled with the impeller 1. In more detailed, the shaft of the motor 3 is connected to the axis of the hub 11 of the impeller 1, so that the motor 3 can drive the impeller 1 to rotate.

In addition, the fans generally includes axial-flow fans and centrifugal fans. In the axial-flow fan, the generated airflow is perpendicular to the impeller. In the centrifugal fan, the external air is sucked from outside to the center of the impeller, and then the impeller causes the airflow with centrifugal inertia, which can be outputted along the tangent direction of the impeller. Of course, the fan 2 is not limited to the axial-flow fan or the centrifugal fan, and the shape of the fan blades 122 and 123 can be designed based on the type of the fan 2 (the axial-flow fan or the centrifugal fan).

Moreover, the fan 2 can further comprise a fan frame, and the impeller 1 and the motor 3 are disposed inside the fan frame. In addition, the fan 2 can be installed on another device (e.g. an electronic device) by the fan frame. The electronic device can be, for example, a notebook computer, a graphic card, a main board, a CPU, a desktop computer, a projector, a computer, and the likes.

FIGS. 3A to 3D are schematic diagrams showing a method for manufacturing the fan blades according an embodiment. As shown in FIGS. 3A to 3D, a method for manufacturing fan blades comprises: cutting a metal plate to obtain a blade plate, wherein the blade plate comprises a plurality of fan blades and a folding portion, and the folding portion is connected to one end of each of the fan blades (see FIG. 3B); pressing the fan blades to form the curved fan blades (see FIG. 3C); and folding the blade plate along the folding portion (see FIG. 3D).

Figure 3A:
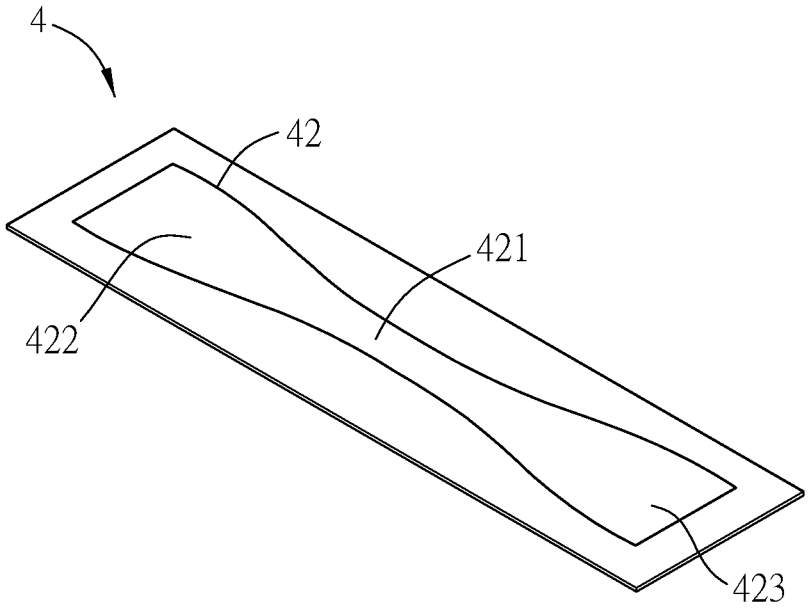
FIGS. 3A to 3D are schematic diagrams showing a method for manufacturing the fan blades according an embodiment.

Referring to FIG. 3A, a whole metal plate 4 is provide, and a blade plate 42 is defined on the metal plate 4. The blade plate 42 comprises a folding portion 421 and two fan blades 422~423. The folding portion 421 connects to one end of each of the fan blades 422 and 423. The metal plate 4 is made of metal material, and it can be a stainless steel plate, an aluminum alloy plate, or the likes. The one ends of the fan blades 422 and 423 can be, for example but not limited to, the roots of the fan blades. The roots of the fan blades 422 and 423 are integrally formed with the folding portion 421 (the same metal plate 4), so it is unnecessary to connect these components.

Figure 3B:
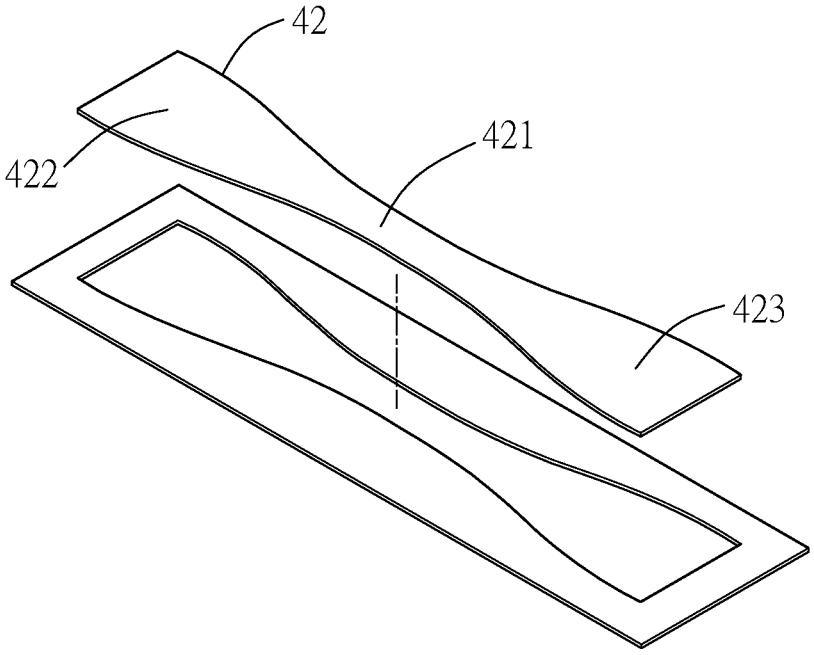

As shown in FIG. 3B, the metal plate 4 is cut to obtain the blade plate 42. In practice, the metal plate 4 can be cut by a cutlery.

Figure 3C:
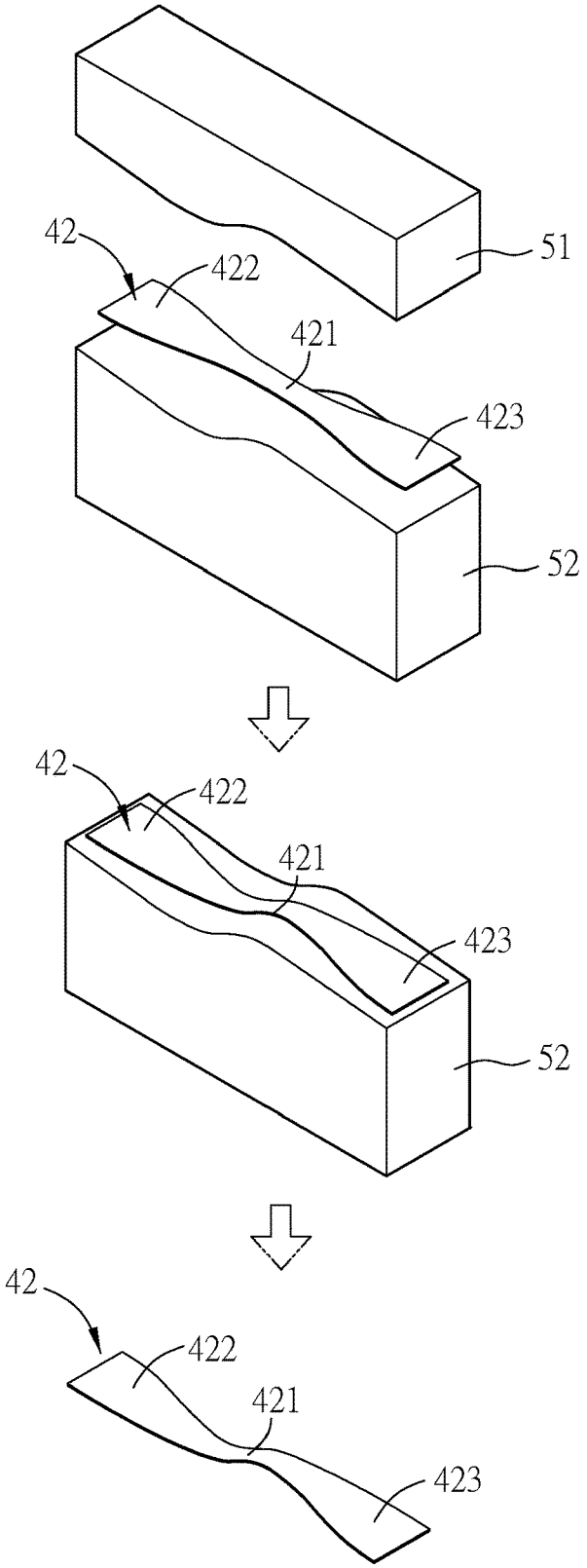

As shown in FIG. 3C, the obtained blade plate 42 (see FIG. 3B) is placed between an upper punch mold 51 and a lower punch mold 52, then the upper punch mold 51 and the lower punch mold 52 move toward each other to perform a punching step. The upper punch mold 51 and the lower punch mold 52 are formed with patterns corresponding to the curved shapes of the fan blades 422 and 423. After the punching step of the molds 51 and 52, the curved shapes of the fan blades 422 and 423 can be formed on the blade plate 42, thereby finishing the shaping of the fan blades 422 and 423. The curved shapes of the fan blades 422 and 423 can be the same as the curved shape of a general fan blade.

Figure 3D:
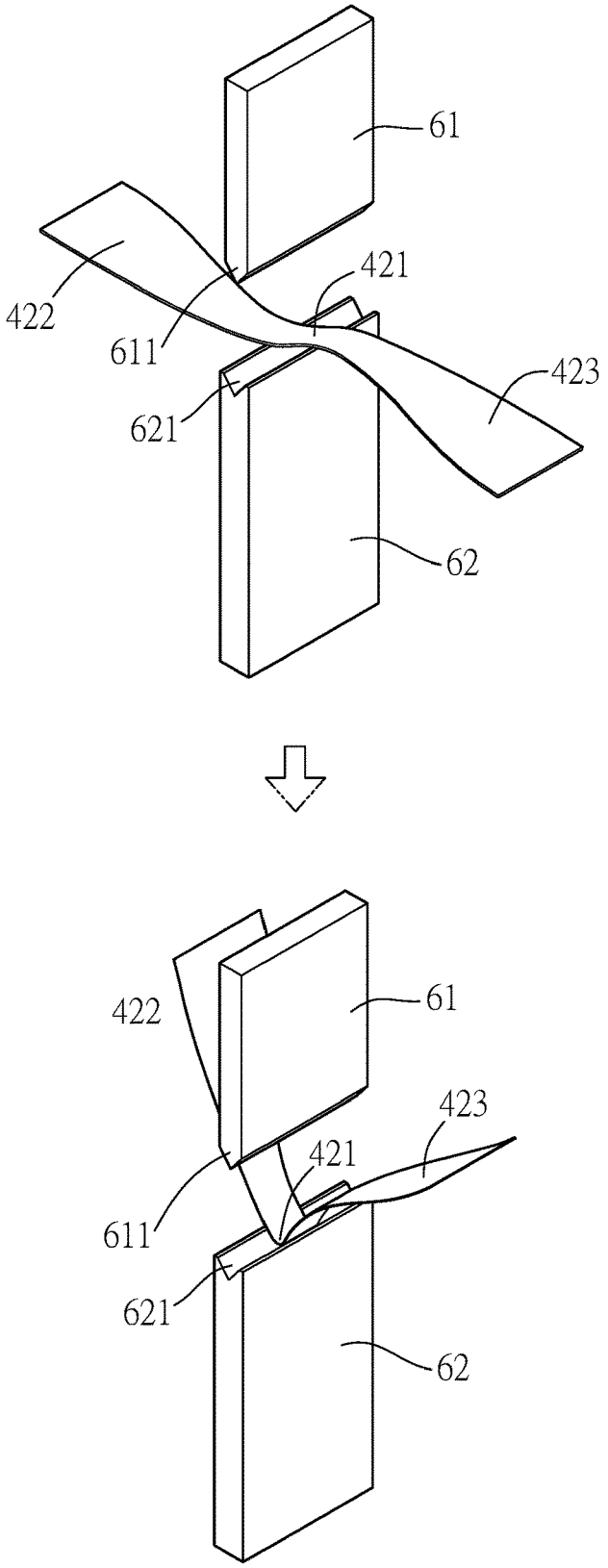

As shown in FIG. 3D, the blade plate 42 of FIG. 3C is placed between an upper punch mold 61 and a lower punch mold 62, then the upper punch mold 61 and the lower punch mold 62 move toward each other to perform a punching step. The upper punch mold 61 and the lower punch mold 62 are formed with patterns corresponding to the curved shape of the folding portion 421. After the punching step of the molds 61 and 62, the curved shape of the folding portion 421 can be formed on the blade plate 42. Then, the blade plate 42 is folded along the folding portion 421, so that an included angle can be formed between the fan blades 422 and 423. The blade plate 42 can, for example but not limited to, be equivalently folded. This punching step is applied to the folding portion 421. To be noted, this punching step should be performed without damaging the shapes of the fan blades 422 and 423. For example, the upper punch mold 61 has a sharp front 611, and the sharp angle of the sharp front 611 is, for example but not limited to, less than 15 degrees. The lower punch mold 62 has a concave front 621. In the punching step, the sharp front 611 can press the folding portion 421 into the concave front 621, so that the folding portion 421 and the fan blades 422 and 423 can form a sharp angle.

Afterwards, the blade plate 42 is removed from the upper punch mold 61 and the lower punch mold 62, and installed in the corresponding installation portion 112 of the hub 11 (see FIG. 1A, 1B or 2).

In another embodiment, a part or all of the blade plates can be configured with two or more fan blades. For example, one blade plate may comprise two, three, four or more fan blades. In another embodiment, a part or all of the blade plates can be configured with even fan blades. For example, one blade plate may comprise two, four or six fan blades.

Figure 4A:
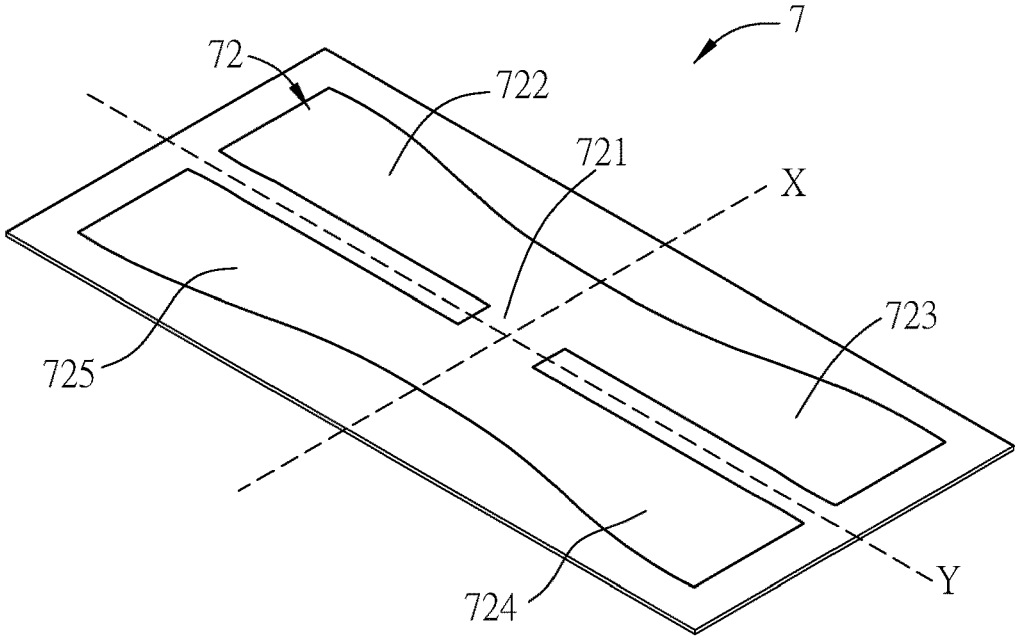
FIG. 4A is a schematic diagram showing a fan blade according to an embodiment.

Referring to FIG. 4A, a blade plate 72 is defined on a metal plate 7. The blade plate 72 comprises a folding portion 721 and four fan blades 722~725. The folding portion 721 connects to one end of each of the fan blades 722~725. An X-axis folding line and a Y-axis folding line, which pass through the folding portion 721, are defined on the blade plate 72. The blade plate 72 is folded twice or more along different folding lines. The metal plate 7 is made of metal material, and it can be a stainless steel plate, an aluminum alloy plate, or the likes.

Figure 4B:
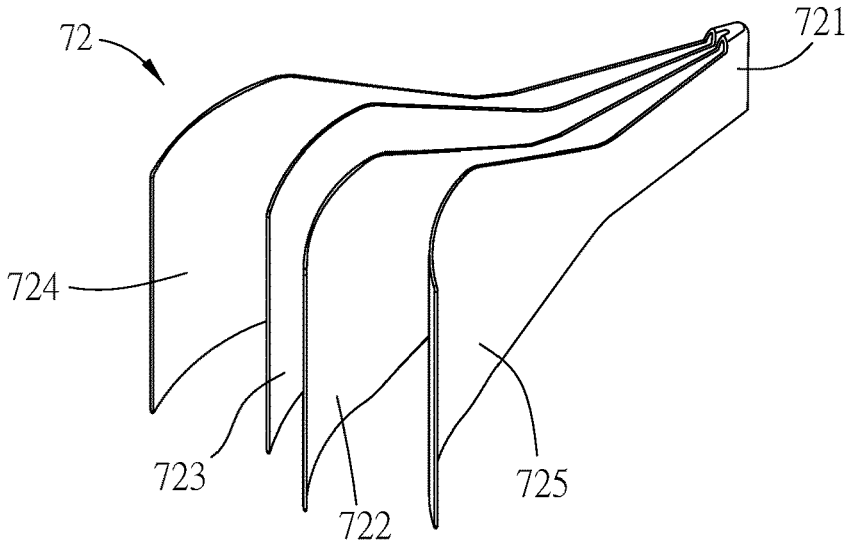
FIG. 4B is a perspective view of the fan blade of FIG. 4A.

The blade plate 72 can be further processed by ways as shown in FIGS. 3B to 3D, and the processed blade plate 72 can be obtained as shown in FIG. 4B. The blade plate 72 as shown in FIG. 4B can be installed in the corresponding installation portion 112 of the hub 11 (see FIG. 1A, 1B or 2). Since the amount of the fan blades in one blade plate 72 is more than two, in the folding step referring to FIG. 3B, the blade plate 72 is folded along the X-axis folding line, and then folded again along the Y-axis folding line. To be noted, in the folding step, the blade plate 72 can also be folded along the Y-axis folding line, and then folded again along the X-axis folding line. This disclosure is not limited. In the case that the blade plate 72 comprises more fan blades, the blade plate 72 can be folded for multiple times along the Y-axis folding line.

In other embodiments, the shapes and sizes of the fan blades in one blade plate can be different.

To sum up, in the impeller and fan of this disclosure, each blade plate comprises a plurality of fan blades. Accordingly, when installing one blade plate on the hub, two or more fan blades can be provided on the hub. Thus, the fan blades are not installed on the hub individually. This design can decrease the assembling time for installing the fan blades on the hub, thereby reducing the manufacturing time of the impeller and the fan.

Moreover, this disclosure can provide multiple fan blades on the hub by installing one blade plate, so the manufacturing procedure becomes simpler. The folding portion of the blade plate can be directly inserted into the hub. The installation procedure of this disclosure is much easier than installing a plurality of individual fan blades.

Furthermore, the blade plates can be made of metal plates, so that the metal blade plates can be manufactured thinner than the convention plastic fan blades. Thus, the generated air quantity becomes larger so as to increase the heat dissipation efficiency.

Although the disclosure has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the disclosure.

What is claimed is:

1. An impeller, comprising:

a hub comprising:

a hub body, and a plurality of installation portions disposed on the hub body, wherein each of the installation portions is a recess; and a plurality of blade plates, wherein each of the blade plates comprises:

a plurality of fan blades, and a folding portion connected to one end of each of the fan blades, wherein the folding portions are respectively inserted into the installation portions, wherein each of the recesses is gradually shrunk from an edge of the hub body toward a center of the hub body, two of the fan blades of the blade plate corresponding to the recess contact against two sides of the recess, and the folding portion contacts against a deepest side of the recess.

2. The impeller according to claim 1, wherein the blade plates are metal plates.

3. The impeller according to claim 1, wherein each of the blade plates is folded along the folding portion so that an included angle is formed between the fan blades.

4. The impeller according to claim 1, further comprising:

a hub cover covering the installation portions and the folding portions and connecting to the hub body and the folding portions.

5. The impeller according to claim 1, wherein shapes and sizes of the fan blades of each of the blade plates are the same.

6. The impeller according to claim 1, wherein the blade plate comprises an even number of the fan blades.

7. A fan, comprising:

an impeller comprising a hub and a plurality of blade plates, wherein the hub comprises a hub body and a plurality of installation portions disposed on the hub body, and each of the installation portions is a recess, each of the blade plates comprises a plurality of fan blades and a folding portion connected to one end of each of the fan blades, and the folding portions are respectively inserted into the installation portions, each of the recesses is gradually shrunk from an edge of the hub body toward a center of the hub body, two of the fan blades of the blade plate corresponding to the recess contact against two sides of the recess, and the folding portion contacts against a deepest side of the recess; and a motor assembled with the impeller.

8. A method for manufacturing fan blades, comprising:

cutting a metal plate to obtain a blade plate, wherein the blade plate comprises a plurality of fan blades and a folding portion, and the folding portion is connected to one end of each of the fan blades;

pressing the fan blades to form the curved fan blades; and folding the blade plate along the folding portion;

wherein the folding portion of the fan blades is inserted into a recess of a hub, and the recess is gradually shrunk from an edge of a hub body of the hub toward a center of the hub body, two of the fan blades of the blade plate corresponding to the recess contact against two sides of the recess, and the folding portion contacts against a deepest side of the recess.

9. The method according to claim 8, wherein a cutlery is used to cut the metal plate to obtain the blade plate.

10. The method according to claim 8, wherein an upper punch mold and a lower punch mold are provided opposite to each other and used to press the fan blades to form the curved fan blades.

11. The method according to claim 8, wherein the blade plates are folded along the folding portion, so that an included angle is formed between the fan blades.

* * * * *